US005220239A

United States Patent [19]

Chen

[11] Patent Number: 5,220,239

[45] Date of Patent: Jun. 15, 1993

[54] HIGH DENSITY ELECTRON BEAM GENERATED BY LOW VOLTAGE LIMITING APERTURE GUN

[75] Inventor: Hsing-Yao Chen, Barrington, Ill.

[73] Assignee: Chunghwa Picture Tubes, Ltd., Taiwan

[21] Appl. No.: 804,297

[22] Filed: Dec. 9, 1991

[51] Int. Cl.[5] ..... H01J 29/48; H01J 29/62

[52] U.S. Cl. ..... 313/414; 313/448; 315/15

[58] Field of Search ..... 313/414, 448; 315/15

[56] References Cited

U.S. PATENT DOCUMENTS

| | | | |
|---|---|---|---|
| 2,070,319 | 2/1937 | Rudenberg | 250/27.5 |
| 2,072,957 | 3/1937 | McGee | 250/27.5 |
| 2,111,941 | 3/1938 | Schlesinger | 250/27.5 |
| 2,128,581 | 8/1938 | Gardner | 250/27.5 |
| 2,135,941 | 11/1938 | Hirmann | 250/27.5 |
| 2,185,590 | 1/1940 | Epstein | 250/155 |
| 2,202,631 | 5/1940 | Headrick | 250/163 |
| 2,209,159 | 7/1940 | Gorlick et al. | 250/27.5 |
| 2,213,688 | 9/1940 | Broadway et al. | 250/160 |
| 2,217,168 | 10/1940 | Hefele et al. | 250/27 |
| 2,229,766 | 1/1941 | Nicoll et al. | 250/27 |
| 2,260,313 | 10/1941 | Gray | 250/27 |
| 2,888,606 | 5/1959 | Beam | 315/16 |
| 3,798,478 | 3/1974 | Say | 313/70 |
| 3,887,830 | 6/1975 | Spencer | 313/443 |
| 3,919,588 | 11/1975 | Parks et al. | 315/14 |
| 3,928,784 | 12/1975 | Weijland | 313/389 |
| 4,009,410 | 2/1977 | Pommier et al. | 313/411 |
| 4,218,635 | 8/1980 | Bedard et al. | 315/17 |
| 4,268,777 | 5/1981 | van Roosmalen | 315/1 |
| 4,388,556 | 6/1983 | Rao | 315/14 |
| 4,467,243 | 8/1984 | Fukushima et al. | 313/448 |
| 4,520,292 | 5/1985 | van Hekken et al. | 313/412 |
| 4,540,916 | 9/1985 | Maruyama et al. | 315/16 |
| 4,549,113 | 10/1985 | Rao | 315/14 |
| 4,608,515 | 8/1986 | Chen | 313/414 X |
| 4,620,133 | 10/1986 | Morrell et al. | 313/414 X |
| 4,628,224 | 12/1986 | Collins et al. | 313/414 |
| 4,724,359 | 2/1988 | Roussin | 315/15 |
| 4,764,704 | 8/1988 | New et al. | 313/414 |
| 4,886,998 | 12/1989 | Endo | 313/414 |

*Primary Examiner*—Sandra L. O'Shea
*Attorney, Agent, or Firm*—Emrich & Dithmar

[57] ABSTRACT

The low voltage beam forming region (BFR) of an electron gun such as used in a cathode ray tube (CRT) includes a reduced aperture in an electrostatic field-free region of the gun's $G_2$ screen grid. The electron gun's $G_1$ control grid is provided with an enlarged aperture to allow more electrons to enter the BFR from the cathode for increased electron beam peak current densities and enhanced video display brightness. The limiting aperture in the $G_2$ grid intercepts outer electrons in the electron beam as well as those electrons having a high velocity transverse to the beam axis for limiting beam spot size and eliminating undesirable "halo" about the electron beam spot on the CRT's display screen. In another embodiment, the spacing between the electron gun's cathode and its $G_1$ control grid is increased to allow the introduction of more electrons in the beam for higher peak electron beam current density while the $G_2$ limiting aperture maintains a small beam spot size for increased video display brightness and improved beam spot resolution. The enlarged $G_1$ aperture may be combined with the increased cathode-$G_1$ control grid spacing in a CRT with a $G_2$ limiting aperture for further improvement in video display brightness and beam spot resolution.

38 Claims, 5 Drawing Sheets

HIGH DENSITY ELECTRON BEAM GENERATED BY LOW VOLTAGE LIMITING APERTURE GUN

FIELD OF THE INVENTION

This invention relates generally to charged particle beams and is particularly directed to a beam forming region in an electron gun such as used in a cathode ray tube for providing a high density electron beam having a small spot size.

BACKGROUND OF THE INVENTION

Recent work in the design and development of high definition television receivers and high resolution cathode ray tube (CRT) monitors has been directed to reducing electron beam spot size and increasing electron beam intensity or the charge density in the beam. Reducing electron beam spot size improves picture resolution, while increasing beam current density permits increased display brightness. One approach to increasing beam current density is to raise the temperature of the electron gun's cathode which then emits a large number of electrons. A conventional oxide cathode is capable of producing an emission current density of only 0.5 $A/cm^2$ over an extended operating lifetime. While electron emission density increases exponentially with increasing cathode temperature, cathode useful lifetime is correspondingly reduced exponentially with increasing operating temperatures. Therefore, in a conventional electron gun employing a typical oxide cathode, it is impossible to achieve a high resolution spot size without shortening cathode useful operating lifetime.

Electron beam optics dictates that at low current ($i \leqq 500\ \mu A$) the focused electron beam spot is roughly proportional to the aperture size of the CRT's $G_1$ control grid and that the total maximum current drawn from the cathode is roughly proportional to the square of the $G_1$ aperture (assuming that cathode emission density remains the same). Therefore, a high resolution electron beam requires a small $G_1$ aperture in the beam forming region (BFR) of the electron gun. This, in turn, reduces beam current resulting in an undesired reduction in video display brightness. Attempts to resolve this dilemma generally involve replacing the conventional oxide cathode with one having a higher current density capability and a long operating lifetime. This combination in a cathode offers a small spot size with both acceptable display brightness and a reasonably long operating lifetime. In order to provide small beam spot size, high video display brightness levels, and acceptable cathode operating lifetimes, many CRT manufacturers have turned to using the dispenser cathode which can sustain many times the current density of a conventional oxide cathode while continuing to offer extended operating lifetimes. However, a dispenser cathode is on the order of 20–50 times more expensive than a conventional oxide cathode. Even when a dispenser cathode is employed, the power requirements of the CRT are usually higher.

Referring to FIG. 1, there is shown a simplified diagrammatic cross-sectional view of pertinent electrical portions of a prior art electron gun 10 such as used in a conventional CRT. Electron gun 10 includes an electron source 12, a low voltage beam forming region (BFR) 14, and a high voltage beam focusing region 16. Although only a single electron gun 10 is shown in the sectional view of FIG. 1, the typical color CRT employs three such electron guns, one for each of the primary colors of red, green and blue. The electron gun 10 has a longitudinal axis A–A' along which an electron beam is directed onto the phosphor coating 20 of a display screen 18 in a CRT. The electron beam is shown for simplicity as a series of closely spaced electron rays 22 extending between a cathode K and the display screen 18. A plurality of charged grids, or electrodes, are disposed along axis A–A' for forming and directing the electron beam onto the display screen 18 as described below.

The electron source 12 includes the heated cathode K and the combination of a $G_1$ control grid and a $G_2$ screen grid for directing energetic electrons from the cathode surface generally along the electron gun's axis A–A' toward the display screen 18. The $G_1$ control grid is disposed adjacent cathode K, while the $G_2$ screen grid is disposed intermediate the $G_1$ control grid and a $G_3$ grid. Each of the $G_1$ control grid and the $G_2$ screen grid includes a generally circular aperture having a diameter $d_{G1}$ and $d_{G2}$, respectively. Apertures $d_{G1}$ and $d_{G2}$ are typically of the same size, although $d_{G2}$ may in some cases be larger than $d_{G1}$ for manufacturing purposes. In addition, the $G_1$ and $G_2$ grids are generally in the form of thin plates having thickness $t_{G1}$ and $t_{G2}$, respectively. Although only one aperture is shown in the cross-sectional view of FIG. 1 for simplicity, each of the $G_1$ control and $G_2$ screen grids includes three spaced apertures, each adapted to receive and pass a respective electron beam in a color CRT. Cathode K, the $G_1$ control grid, the $G_2$ screen grid, and a portion of the $G_3$ grid facing the $G_2$ grid comprise the low voltage BFR 14 of the electron gun 10. The $G_3$ grid also includes an aperture 33 through which the electrons are directed. The $G_3$ grid is coupled to a focus voltage ($V_F$) source 36 for focusing the electrons beam to a sharply defined spot on the display screen 18.

One or more beam focusing grids ($G_4$, $G_5$, etc.) can be disposed intermediate the $G_3$ grid and the display screen 18 for focusing the electron beam to a spot on the display screen's phosphor coating 20. Usually the last grid has the anode voltage $V_A$ which combines with the adjacent focus voltage $V_F$ grids to form the main focusing lens. In our case (FIG. i), the main lens is formed of the $G_3$ and $G_4$ grids. The path of travel of the electrons between cathode K and the display screen 18 is shown as a plurality of the aforementioned closely spaced electron rays 22 in the figure. The electrons are drawn from the cathode K over a generally circular area having a diameter $d_K$. With each of the grids charged to a predetermined potential, or voltage, a complex electrostatic field is established within the electron gun 10. The electrostatic field within a portion of the electron gun 10 is represented by a series of equipotential lines 24 shown in dotted-line form disposed about the longitudinal axis A–A' of the electron gun 10. The electrostatic field represented by the equipotential lines 24 causes the convergence of the electron rays 22 in the BFR 14 such that the electron rays typically form a crossover of axis A–A' intermediate the $G_2$ screen grid and the $G_3$ grid. The electron rays 22 are then permitted to diverge somewhat to a diameter of $d_s$ before being focused by one or more focusing grids represented by the $G_4$ grid. The electron beam is focused to a small spot on the screen's phosphor coating 20.

In a conventional CRT electron gun design, the $G_1$ and $G_2$ aperture diameters are generally equal which facilitates assembly of the electron gun. There has thus been no incentive to make the $G_1$ grid's aperture larger than that of the $G_2$ grid. In addition, during operation the "hot" cathode-to-$G_1$ grid spacing $D_G$ in a conventional CRT electron gun design is preferably on the order of 0.08 mm. However, due to manufacturing difficulty, the actual "hot" spacing can be controlled to only a limited degree. Increasing the cathode-to-$G_1$ grid spacing gives rise to a "halo" about the focused electron beam spot on the CRT display screen caused by energetic electrons having a large thermal velocity component transverse to the axis of the electron beam. These high transverse thermal velocity electrons are incident upon the display screen about the center image of the electron beam spot giving rise to a halo, or haze, surrounding the individual electron beams pixel in the pattern array which significantly detracts from the quality of the video image.

The present invention addresses and overcomes the aforementioned limitations of the prior art by providing a beam forming arrangement in an electron gun capable of providing a high density electron beam having a small spot size using conventional cathode materials operating at normal temperatures.

OBJECTS AND SUMMARY OF THE INVENTION

Accordingly, it is an object of the present invention to provide a smaller, brighter focused electron beam spot for use in high definition television receivers and high resolution CRT monitors.

Another object of the present invention is to provide increased Gaussian peak current distribution in an electron beam while maintaining a small beam spot size for improved video image quality in a CRT.

Yet another object of the present invention is to admit an increased number of electrons in the beam forming region of an electron gun for higher beam current density without increasing cathode temperature and shortening cathode operating lifetime or employing exotic, expensive cathode materials.

A further object of the present invention is to increase electron beam current density in an electron gun by increasing the diameter of the $G_1$ grid aperture and/or cathode $G_1$ grid spacing while maintaining a small beam spot size and eliminating high transverse thermal velocity electrons and associated video image halo.

A still further object of the present invention is to provide a relatively inexpensive high resolution electron gun for use in a high definition television receiver or high definition CRT monitor.

The objects of the present invention are achieved and the disadvantages of the prior art are eliminated by an electron gun for directing an electron beam on a display screen, the electron gun having a low voltage beam forming region (BFR) and a high voltage focusing and accelerating region wherein electrons are accelerated by an anode voltage $V_A$ toward the display screen, the electron gun comprising: a cathode for emitting thermal electrons in the general direction of an axis of the electron gun; a first charged grid disposed in a spaced manner from the cathode on the axis and having a first aperture with a diameter $d_1$ through which the electrons are directed; a second charged grid disposed in a spaced manner from the first charged grid on the axis and intermediate the first charged grid and the display screen and having first and second recessed portions extending inwardly from opposed facing surfaces of the second charged grid and aligned on the axis, with each of the recessed portions having a diameter $d_2$, with $d_1 > d_2$ for admitting an increased number of electrons in the beam in increasing electron beam current density, wherein the electrons are directed through the first and second recessed portions toward the display screen, the second charged grid further including means for forming a relatively electrostatic field-free region on the axis within the second charged grid; and means defining a limiting aperture on the axis in the relatively electrostatic field-free region of the second charged grid for removing electrons in a peripheral portion of the electron beam in reducing electron beam spot size on the display screen.

The present invention further contemplates an electron gun for directing an electron beam on a display screen, the electron gun having a low voltage beam forming region (BFR) and a high voltage focusing and accelerating region wherein electrons are accelerated by an anode voltage $V_A$ toward the display screen, the electron gun comprising: a cathode for emitting thermal electrons in the general direction of an axis of the electron gun; a first charged grid disposed in a spaced manner from the cathode on the axis and having a first aperture with a diameter $d_1$ through which the electrons are directed, wherein the spacing between the cathode and the first charged grid is such as to admit an increased number of energetic electrons in the beam for increased electron beam current density; a second charged grid disposed in a spaced manner from the first charged grid and on the axis and intermediate the first charged grid and the display screen and having first and second recessed portions extending inwardly from opposed facing surfaces of the second charged grid and aligned on the axis, with each of the recessed portions having a diameter $d_2$, wherein the electrons are directed through the first and second recessed portions toward the display screen and the second charged grid further includes means for forming a relatively electrostatic field-free region on the axis within the second charged grid; and means disposed on the axis of the electron gun in the relatively field-free region of the second charged grid for removing electrons disposed about the periphery of the electron beam as well as electrons having a high velocity transverse to the axis in reducing electron beam cross-section and electron beam spot size on the display screen.

BRIEF DESCRIPTION OF THE DRAWINGS

The appended claims set forth those novel features which characterize the invention. However, the invention itself, as well as further objects and advantages thereof, will best be understood by reference to the following detailed description of a preferred embodiment taken in conjunction with the accompanying drawings, where like reference characters identify like elements throughout the various figures, in which:

In FIGS. 5 and 6, with the help of the mathematical formulas, it is clearly shown that the inventive electron gun provides a smaller spot size compared to the conventional gun.

DESCRIPTION OF THE PREFERRED EMBODIMENT

Figure 2:
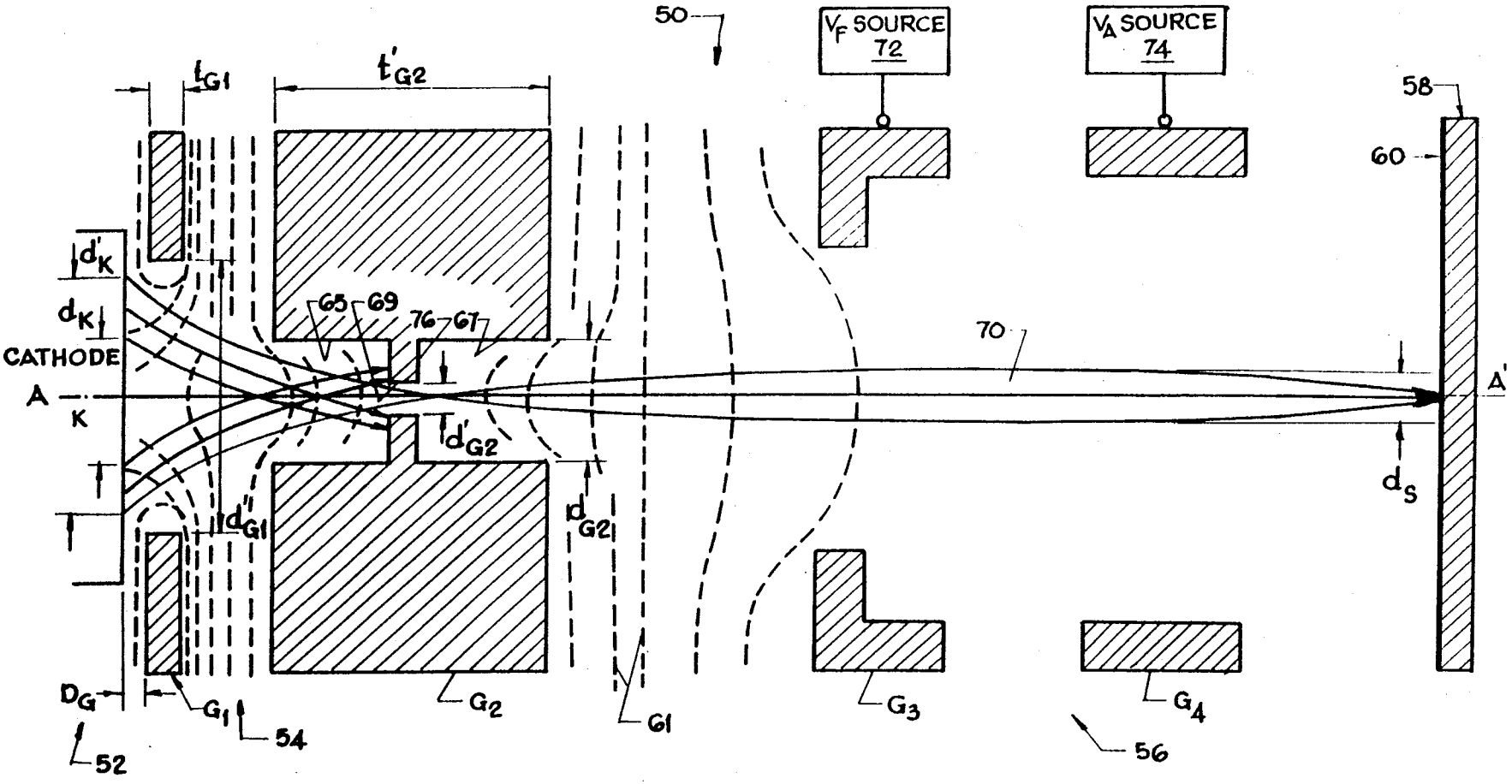
FIG. 2 is a simplified diagrammatic cross-sectional view of pertinent electrical portions of a first embodiment of an electron gun arrangement in a CRT for providing a high density electron beam with a small beam spot size in accordance with the present invention.

Referring to FIG. 2, there is shown a simplified diagrammatic cross-sectional view of pertinent electrical portions of one embodiment of an electron gun 50 for use in a CRT in accordance with the principles of the present invention. Electron gun 50 includes an electron source 52, a low voltage BFR 54, and a high voltage beam focusing region 56. In FIG. 2 10 and other figures discussed below, the same identifying number has been assigned to common elements in the various electron guns. The electron source 52 includes a heated cathode K which directs energetic electrons along a longitudinal axis A–A' toward a display screen 58 of a CRT in which the electron gun is installed. The electron beam is incident upon a phosphor coating 60 on an inner surface of the display screen 58 to produce a video image on the display screen.

The low voltage BFR 54 includes a $G_1$ control grid, a $G_2$ screen grid, and a portion of a $G_3$ grid facing the $G_2$ grid. The $G_1$ control grid is typically operated at a negative potential relative to the cathode K and serves to control electron beam intensity in response to the application of a video signal thereto, or to the cathode K. The $G_2$ grid is operated at a preferred positive potential so as to draw the electrons from the cathode K in the general direction of the display screen 58.

The $G_3$ grid is coupled to a focusing voltage ($V_F$) source 72 to form a focus lens for focusing the electron beam on and accelerating the electrons toward the display screen 58 and generally along axis A–A'. One or more grids can be disposed intermediate the $G_3$ grid and the display screen 58 for focusing the electron beam on the display screen's phosphor coating 60 As shown in the figure, a $G_4$ grid is disposed intermediate the $G_3$ grid and the display screen 58. A $V_A$ source 74 is coupled to the $G_4$ grid for providing an anode voltage $V_A$ thereto.

The electron beam is shown as a series of closely spaced electron rays 70 extending between the cathode K and the display screen 58. As shown in the figure, the energetic electrons are emitted from a large surface having a diameter $d_k'$ on the cathode K. The electron rays 70 are then directed toward the axis A–A', or are bent inwardly by the combination of the $G_1$ control grid and the $G_2$ screen grid. The electrons form a crossover on the A–A' axis generally intermediate the $G_2$ screen grid and the $G_3$ grid.

Figure 1:
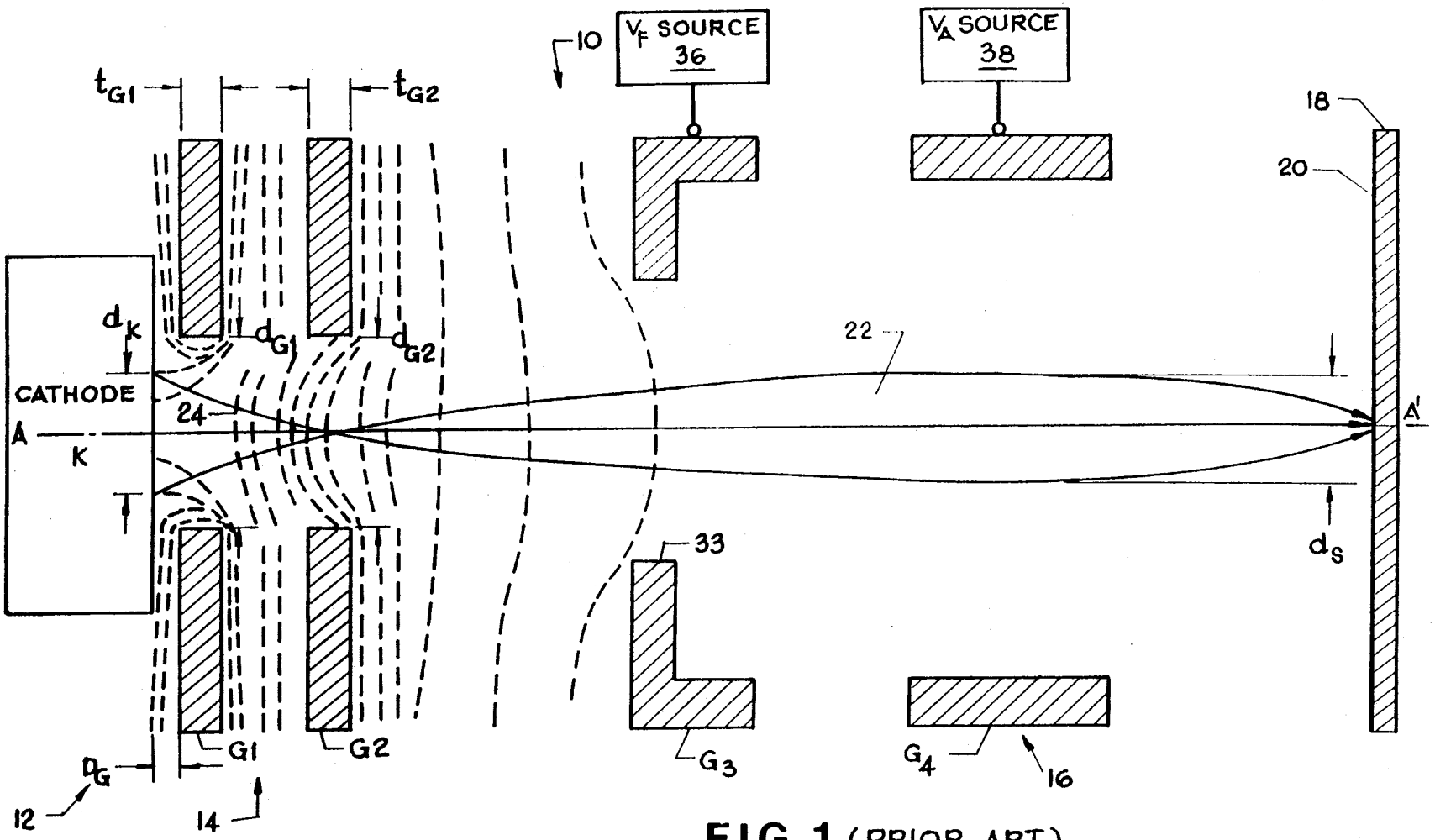
FIG. 1 (PRIOR ART)
FIG. 1 is a simplified diagrammatic cross-sectional view of pertinent electrical portions of a prior art multibeam CRT employing a conventional electron gun which also illustrates the spacing and shape of equipotential lines within the electron gun.

As shown in FIG. 2, the $G_1$ control grid has a thickness $t_{G1}$ and includes a generally circular aperture having a diameter $t_{G1}'$. Similarly, the $G_2$ screen grid has a thickness of $t_{G2}'$ and includes a pair of generally circular recessed portions 65 and 67 extending inwardly from opposed surfaces thereof along axis A–A'. Each of the recessed portions 65, 67 has a diameter $d_{G2}$. Aperture $d_{G1}'$ and recessed portions 65 and 67 are in common alignment along axis A–A'. It should be kept in mind that in a color CRT the $G_1$ control grid includes three such apertures each having a diameter $d_{G1}'$. From the figure, it can be seen that $t_{G2}' >> t_{G1}$ and $D_{G1}' > d_{G2}$ in accordance with the present invention. In comparing FIGS. 1 and 2, it can also be seen that the aperture in the $G_1$ control grid in the invention of FIG. 2 is larger than the aperture in the prior art $G_1$ control grid, or $d_{G1}'$ $d_{G1}$. The increased diameter $d_{G1}'$ of the aperture in the $G_1$ control grid allows energetic electrons from a larger generally circular area having a diameter $d_K'$ to enter the electron beam. The diameter $d_K$ of the surface area of the cathode K in the prior art electron gun 10 shown in FIG. 1 is shown in FIG. 2 for the sake of comparison From FIG. 2, it can be seen that $d_K' > d_K$ because of the increased diameter $d_{G1}'$ of the aperture in the $G_1$ control grid in this embodiment of the present invention.

The $G_2$ screen grid further includes a generally circular limiting aperture 69 (or three such limiting apertures in a color CRT) formed by an inwardly directed partition 76, or wall, containing the limiting aperture. Limiting aperture 69 is generally circular having a diameter $d_{G2}'$. In comparing FIGS. 1 and 2, it can be seen that the $G_2$ screen grid in the present invention of FIG. 2 is provided with an increased thickness $t_{G2}'$ along the axis A–A'. In a preferred embodiment, $$t_{G2}' \geqq 1.8\ d_{G2}, \text{ and}$$

$$300V \leqq V_{G2} \leqq 0.12\ V_A,$$

where $V_{G2}$ is the potential applied to the $G_2$ screen grid and $V_A$ is the aforementioned anode voltage provided to the $G_4$ grid. As indicated above, $V_{G1}$ is typically a negative potential relative to the cathode K for controlling the intensity of the electron beam in response to the application of a video signal to cathode K. Also as described above, the $G_2$ grid generally serves to control the cutoff voltage of the cathode K and direct the electrons in the general direction of the display screen 58.

Aligned recessed portions 65 and 67 are disposed on opposed surfaces of the $G_2$ screen grid and are aligned along axis A–A'. Partition 76 is disposed intermediate the recessed portions 65, 67 and defines the limiting aperture 69. The facing recessed portions 65, 67 in the $G_2$ screen grid cause the electrostatic field to be reduced essentially to zero within the grid along the axis A–A' at the location of the limiting aperture 69. Partition 76 containing the limiting aperture 69 limits electron beam spot size by intercepting and blocking peripheral electrons in the beam as well as those electrons having a high velocity transverse to axis A–A'. In a preferred embodiment, $d_{G1}' \geqq 15\%$ larger than $d_{G2}$, or $D_{G1}'/d_{G2} \geqq 1.15$, and the voltage on the $G_2$ grid is less than or equal to 12% of the anode voltage ($V_{G2} \leqq 12\%$ $V_A$).

FIG. 2 also illustrates the manner in which outer electron beam rays as well as energetic electrons having high thermal velocity transverse to the electron beam axis are removed from the electron beam by the limiting $G_2$ aperture 69. As shown in the figure, the larger surface area $d'_K$ of cathode K which emits energetic electrons into the low voltage BFR 54 of electron gun 50 gives rise to an electron beam having a greater number of electrons than the prior art beam of FIG. 1. The peripheral electrons in the beam as well as those having high transverse velocities are intercepted by the inner partition 76 defining the limiting aperture 69 in the $G_2$ screen grid. By removing the outer electron rays as well as electrons having high thermal velocity transverse to the beam axis from the electron beam, a smaller beam cross-section $d_s'$ is provided in the high voltage beam forming region 56 of the electron gun 50. With $d_s'$ smaller than the prior art beam cross-section $d_s$ of FIG. 1, the electron beam is focused to a smaller spot on the display screen's phosphor coating 60 for improved video image resolution.

Figure 2A:
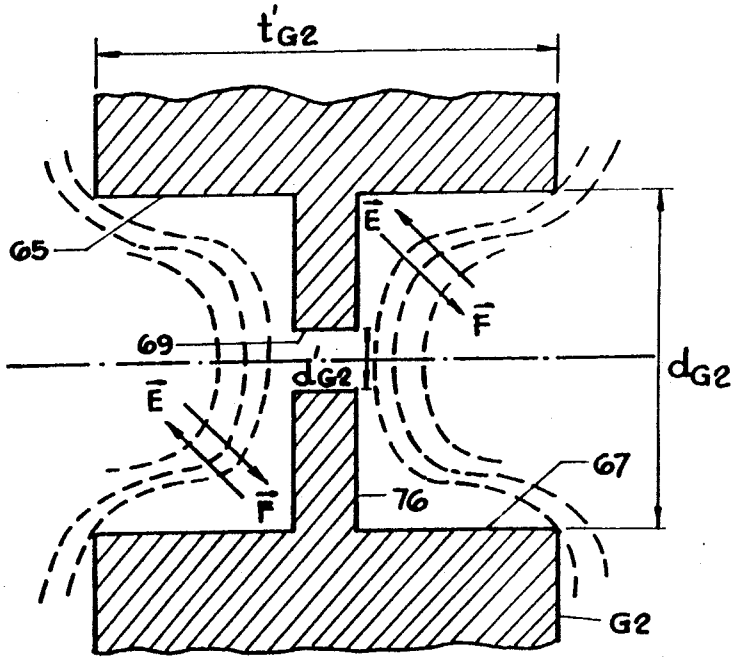
FIG. 2*a* shows a portion of the inventive electron gun of FIG. 2 illustrating the configuration of equipotential lines and associated electrostatic fields and forces imposed on electrons in the beam in the vicinity of the $G_2$ screen grid.

Referring to FIG. 2*a*, there is shown a portion of the inventive electron gun of FIG. 2 illustrating the configuration of equipotential lines and associated electrostatic fields and forces applied to the electrons in the vicinity of the limiting aperture-bearing $G_2$ grid of the electron gun in accordance with the present invention. Equipotential lines are shown in dotted-line form adjacent the $G_2$ grid, and in particular adjacent the limiting aperture 69 in the $G_2$ grid. From the figure, it can be seen that the recessed portions 65, 67 of the $G_2$ grid which are separated by partition 76 containing the limiting aperture 69 form equipotential lines which bend inwardly toward the limiting aperture. Because the thickness of the $G_2$ grid is such that $t_{G2}' \geqq 1.8\ d_{G2}$, the equipotential lines are essentially zero in the immediate vicinity of limiting aperture 69. The electrostatic field, represented by the field vector $\vec{E}$, applies a force represented by the force vector $\vec{F}$ to an electron, where $\vec{F} = -e\ \vec{E}$, where "e" is the charge of an electron. An electrostatic field is formed between two charged electrodes, where the $G_1$ grid is operated at a negative potential relative to the cathode, while the $G_2$ voltage is preferably varied between 300V and 0.12 $V_A$, and $G_3$ is preferably maintained at the focus voltage $V_F$. As shown in the figure, the electrostatic field $\vec{E}$ is aligned transverse to the equipotential lines, as is the force $\vec{F}$ which is opposite in direction to the electrostatic field lines $\vec{E}$ because of the negative electron charge. As the electron beam traverses the space between the $G_1$ and $G_2$ grids, it experiences a diverging force as shown by the direction of the force vector $\vec{F}$. This diverging force field causes a limited dispersal of the electrons within the beam to reduce beam space charge effect. A portion of the outer periphery of the electron beam strikes the inner portion of the $G_2$ grid defining the limiting aperture 6 to cut off the outer periphery of the electron beam. This limits electron beam spot size on the display screen 58. Electrons having high velocity transverse to axis A-A' are also intercepted and removed from the beam by the inner partition 7 defining the limiting aperture 69. This eliminates the aforementioned "halo" around the electron beam spot on the display screen 58. Intermediate the $G_2$ and $G_3$ grids, the electrostatic field vector $\vec{E}$ is again directed toward the electrode with the lower voltage, while the force vector $\vec{F}$ is directed toward the electrode maintained at the greater potential because of the electron's negative charge. Thus, as he electrons transit the space between the $G_2$ and $G_3$ grids, they are subjected to a converging force which causes the electrons to form a first crossover. The first crossover is basically caused by the electrostatic field in the K-$G_1$ and $G_1$-$G_2$ regions. The low voltage side of the $G_2$ screen grid thus operates as a diverging lens, while the high voltage side of the $G_2$ screen grid adjacent the $G_3$ grid functions as a converging lens to effect electron beam crossover.

Figure 3:
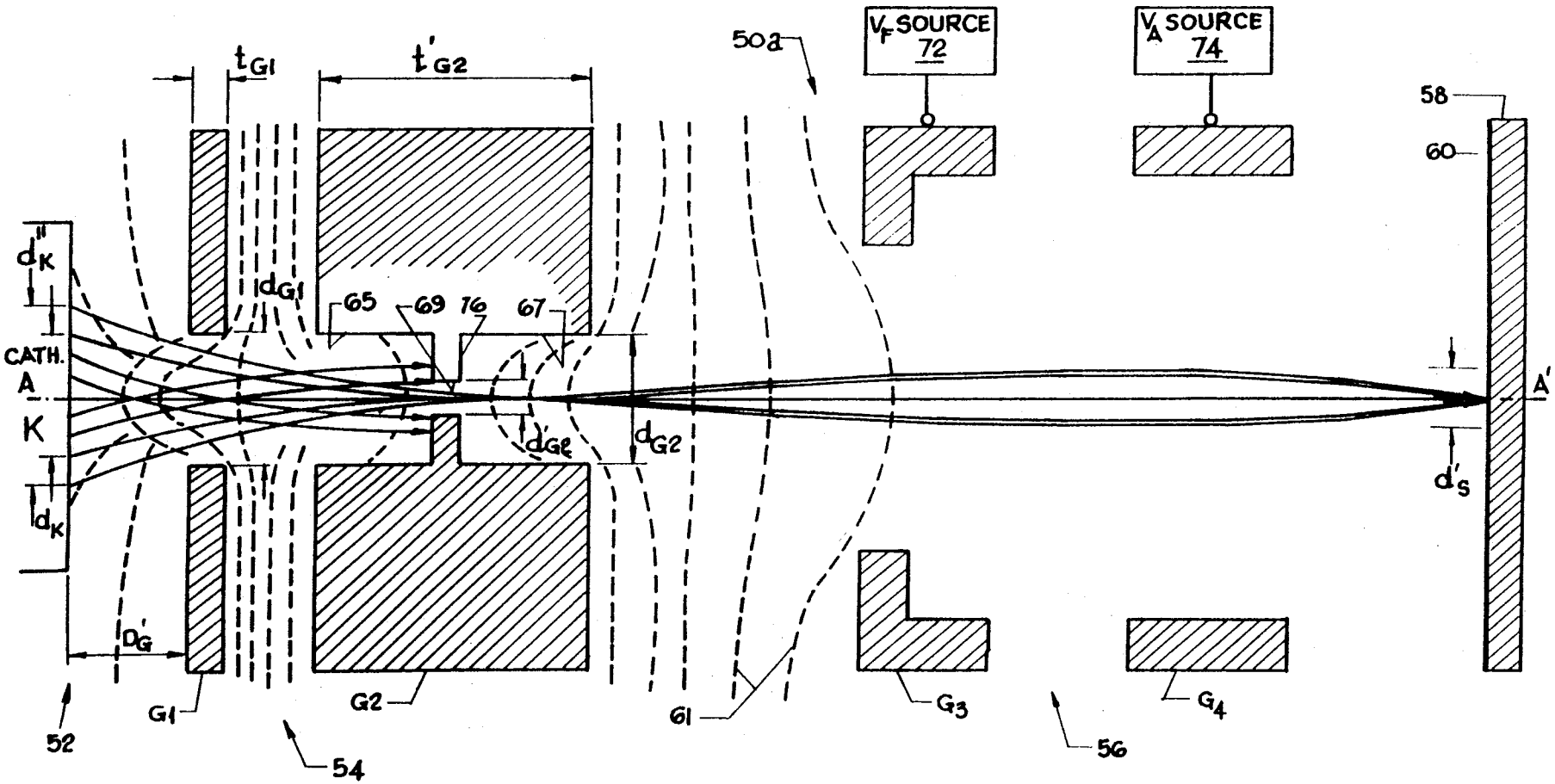
FIG. 3 is a simplified diagrammatic cross-sectional view of pertinent electrical portions of another embodiment of an electron gun in a CRT for providing a high density electron beam with a small beam spot size in accordance with the present invention.

Referring to FIG. 3, there is shown another embodiment of an electron gun 50*a* in accordance with the principles of the present invention. In the embodiment of the inventive electron gun 50*a* shown in FIG. 3, the spacing between cathode K and the $G_1$ control grid has been increased to $D'_G$ from $D_G$ of the prior art electron gun 10 shown in FIG. 1, where $D'_G > D_G$. In a preferred embodiment, the cathode-$G_1$ control grid spacing during operation ("hot" spacing) in the inventive electron gun 50*a* is on the order of 0.01 inch (0.254 mm), as compared to the typical cathode-$G_1$ control grid spacing of 0.003 inch (0.08 mm) in the prior art electron gun 10 shown in FIG. 1. Increased spacing between cathode K and the $G_1$ control grid allows for a larger cathode surface area having a diameter $d_K''$ to direct energetic electrons into the electron gun's low voltage BFR 54. These energetic electrons are urged toward the electron gun's axis A-A' by the electrostatic field established by the $G_1$ control grid and the $G_2$ screen grid. The increased cathode surface area $d_K''$ allows for a greater number of electrons to enter the electron beam giving rise to increased beam peak density for enhanced video image brightness. As in the prior embodiment of the invention, the electrons in the periphery of the beam as well as electrons having high transverse thermal velocity to axis A-A' are removed from the beam by the inner partition 76 defining the limiting aperture 69 in the $G_2$ screen grid to maintain a small electron beam spot size and prevent beam spot "halo".

In the embodiment of FIG. 3, as in the previously described embodiment, $d_{G2} > d_{G2}'$ and $t_{G2}' >> t_{G1}$. In addition, $t_{G2}' \geqq 1.8\ d_{G2}$ and the voltage on the limiting aperture $G_2$ screen grid is equal to or less than 12% of the anode voltage $V_A$. In the embodiment of FIG. 3, $d_{G1} \approx d_{G2}$ as in the prior art relationship between the apertures in the $G_1$ control grid and $G_2$ screen grid.

Figure 4:
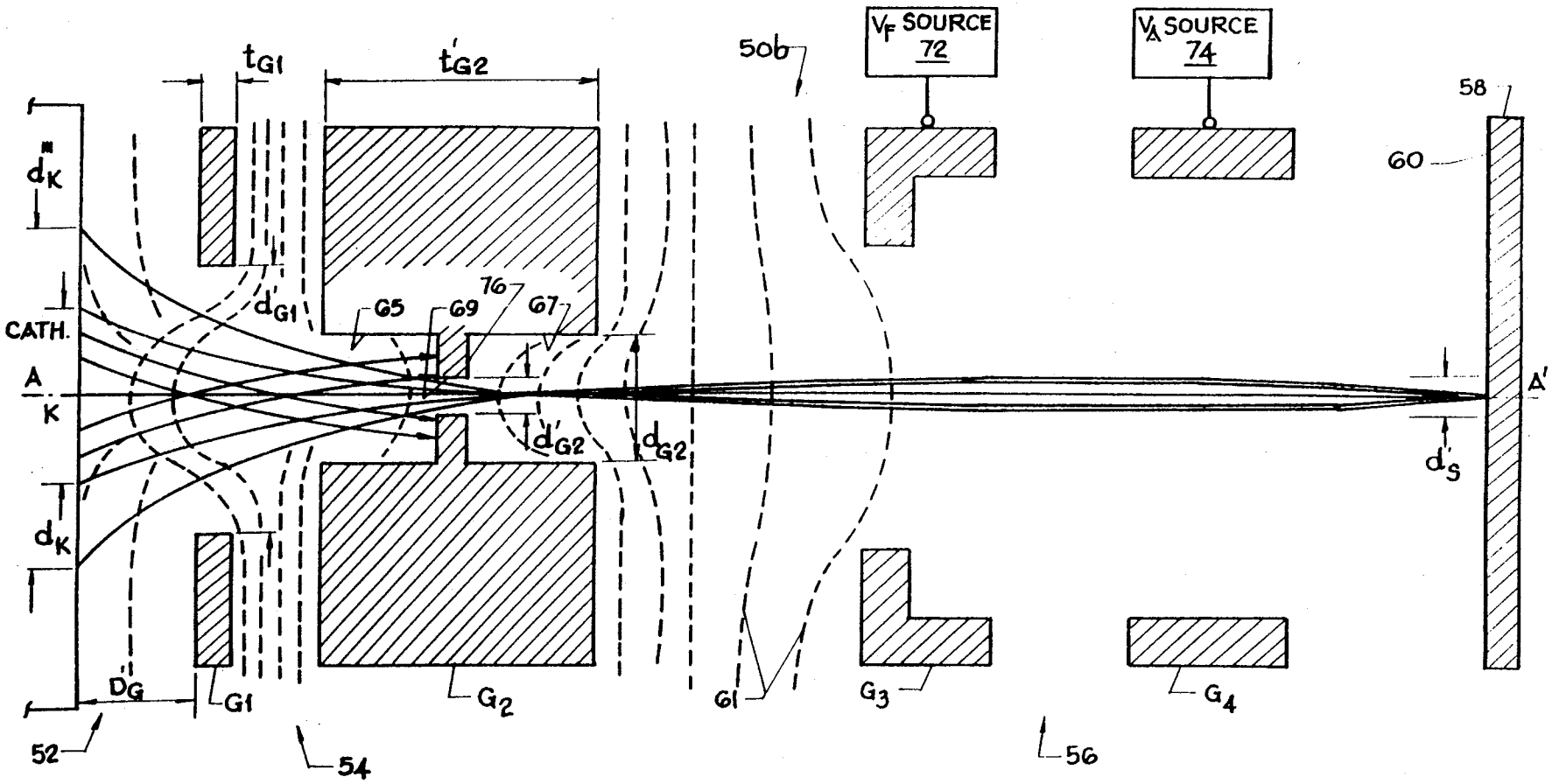
FIG. 4 is a simplified diagrammatic cross-sectional view of pertinent electrical portions of yet another embodiment of an electron gun in accordance with the present invention combining the embodiments of FIGS. 2 and 3.

Referring to FIG. 4, there is shown yet another embodiment of an electron gun 50*b* which includes the combination of the embodiments of FIGS. 2 and 3. In this embodiment, the cathode K-$G_1$ control grid spacing $D_G'$ is increased over the corresponding spacing $D_G$ in the prior art electron gun 10 of FIG. 1, or $D_G' > D_G$. In addition, the $G_1$ control grid is provided with an aperture having an increased diameter $d_{G1}'$ over the aperture $d_{G1}$ of the prior art electron gun. The combination of the increased cathode K-$G_1$ control grid spacing $D_G'$ and the enlarged aperture $d_{G1}'$ in the $G_1$ control grid provides an even larger diameter cathode surface area $D_K'''$ for increased electron density within the beam. A comparison of the embodiment of FIG. 4 with the previously described embodiments of the present invention as well as with the prior art electron gun 10 of FIG. 1 shows that $d_K''' > d_K''$ (or $d_K') > d_K$ (prior art). Also as in the embodiments previously described, the inner partition 76 in the $G_2$ screen grid defining the limiting aperture 69 intercepts and removes peripheral electrons as well as those electrons having high transverse velocities relative to the axis A-A' from the beam. Finally, the embodiment of FIG. 4 provides a reduced electron beam diameter $d'_s$ in the high voltage beam forming region 56 of the electron gun 50*b*.

Figure 5:
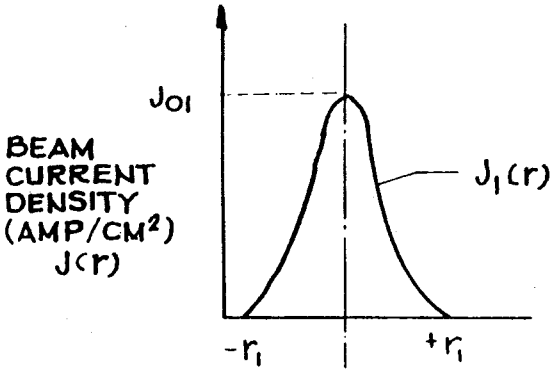
FIG. 5 (PRIOR ART)
FIGS. 5 and 6 are graphic representations of the variation of electron beam current density with distance from the beam axis for a prior art electron gun and for an electron gun in accordance with the present invention, respectively.
Figure 6:
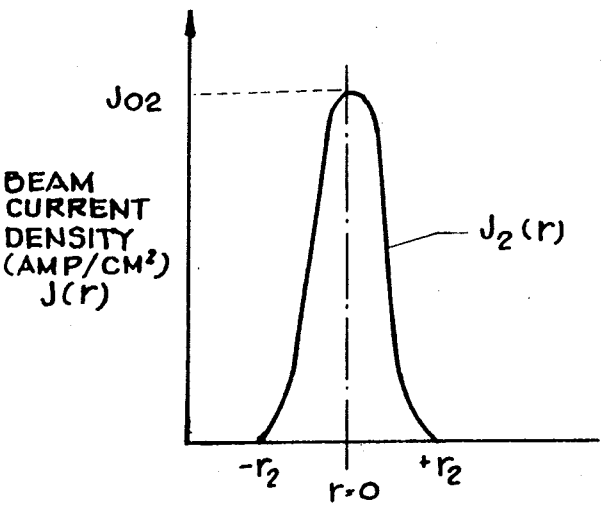

Referring to FIGS. 5 and 6, there are shown graphic representations of the variation of electron beam current density J with distance r from the beam axis A–A' for a prior art electron gun and for an electron gun in accordance with the present invention, respectively. The Gaussian peak current distribution curve for the prior art electron gun shown in FIG. 5 indicates a maximum beam current density of $J_{01}$. FIG. 6 indicates a maximum beam current density of $J_{02}$ for an electron gun in accordance with the present invention, where $J_{02} > J_{01}$. The peak current $J_{02}$ of the inventive electron gun is thus greater than the peak current $J_{01}$ of the prior art electron gun. The Gaussian current distribution J(r) is given by the expression:

$$J(r) = J_0 e^{-Br^2}.$$

where r = distance from beam axis;

$J_0$ = current density along beam axis; and

B = a temperature related parameter.

The total current in the electron beam of the prior art electron gun of FIG. 5 equals the total current in the electron beam of the inventive electron gun of FIG. 6, or $$\int_{-\infty}^{-\infty} J_1(r)dr = \int_{-\infty}^{+\infty} J_2(r)dr$$

Since $J_{02} > J_{01}$, as shown in FIGS. 5 and 6, therefore $$|r_2| < |r_1|.$$

The electron beam spot size on the display screen is thus smaller in the inventive electron gun than the electron beam spot size in the prior art electron gun.

There has thus been shown an electron gun for generating and directing a high density electron beam on the display screen of a CRT. In one embodiment, the electron gun employs a $G_1$ control grid having an enlarged aperture for receiving and admitting an increased number of energetic electrons from the cathode into the electron beam. In another embodiment, the electron gun employs increased spacing between the cathode and the $G_1$ control grid for also admitting an increased number of energetic electrons into the electron beam. Both approaches result in an increased electron beam current density for enhanced video display brightness. Both embodiments employ in the low voltage beam forming region of the electron gun a limiting aperture in the $G_2$ screen grid. The limiting aperture through which the electron beam is directed intercepts outer electrons on the periphery of the beam as well as those electrons having a high thermal velocity transverse to the beam axis for limiting beam spot size and eliminating undesirable "halo" about the electron beam spot on the CRT's display screen. The enlarged $G_1$ aperture of the first embodiment may be combined with the increased cathode-$G_1$ grid spacing of the second embodiment in an electron gun with a $G_2$ limiting aperture for further improvement in video display brightness and beam spot resolution.

While particular embodiments of the present invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention. The matter set forth in the foregoing description and accompanying drawings is offered by way of illustration only and not as a limitation. The actual scope of the invention is intended to be defined in the following claims when viewed in their proper perspective based on the prior art.

I claim:

1. An electron gun for directing an electron beam on a display screen, said electron gun having a low voltage beam forming region (BFR) and a high voltage focusing and accelerating region wherein electrons are focused by a main lens and accelerated by an anode voltage $V_A$ toward said display screen, said electron gun comprising:

cathode means for emitting thermal electrons in the general direction of an axis of the electron gun;

a first charged grid disposed in a spaced manner from said cathode means on said axis and having a first aperture with a diameter $d_1$ through which the electrons are directed;

a second charged grid disposed in a spaced manner from said first charged grid on said axis and intermediate said first charged grid and the main lens and having first and second recessed portions extending inwardly from opposed facing surfaces of said second charged grid and aligned on said axis, with each of said recessed portions having a diameter $d_2$, with $d_1 > d_2$ for admitting an increased number of electrons in the beam in increasing electron beam current density, wherein the electrons are directed through said first and second recessed portions toward the main lens and then accelerated toward the display screen, said second charged grid further including means for forming a relatively electrostatic field-free region on said axis within said second charged grid; and means defining a limiting aperture on said axis in the relatively electrostatic field-free region of said second charged grid for removing electrons in a peripheral portion of the electron beam in reducing electron beam spot size on the display screen.

2. The electron gun of claim 1 wherein said limiting aperture is generally circular having a diameter $d_2'$ and said means defining said limiting aperture is disposed intermediate said first and second recessed portions of said second charged grid.

3. The electron gun of claim 2 wherein said second charged grid has a thickness $t_2$, where $t_2 \geqq 1.8\ d_2$.

4. The electron gun of claim 3 wherein $t_2 \geqq 0.54$–$1.44$ mm and $d_2 = 0.3$–$0.8$ mm.

5. The electron gun of claim 3 wherein $d_2' = 10$–$50\%\ d_2$.

6. The electron gun of claim 5 wherein said charged grid is maintained at a potential of $V_{G2}$, where $300V \leqq V_{G2} \leqq 0.12\ V_A$, where $V_A$ is the anode voltage.

7. The electron gun of claim 3 wherein said means for defining said limiting aperture is disposed approximately midway between the opposed surfaces of said second charged grid.

8. The electron gun of claim 7 wherein said means for defining said limiting aperture includes an inwardly extending partition disposed intermediate and aligned with said first and second recessed portions and having a circular aperture in the center thereof.

9. The electron gun of claim 1 wherein said electron gun is in a color cathode ray tube (CRT) and includes three inline cathode means and wherein said first charged grid includes three first apertures and said second charged grid includes three pairs of first and second recessed portions and three limiting apertures aligned with said three first apertures of said first charged grid for forming and directing three inline electron beams onto the display screen.

10. The electron gun of claim 9 further including three inline high voltage focusing means for focusing said three electron beams on the display screen.

11. The electron gun of claim 1 wherein $d_1 \leqq 15\%$ larger than $d_2$.

12. The electron gun of claim 1 wherein the spacing $D_G$ between said cathode means and said first charge grid is such as to admit an increased number of thermal electrons in the beam for increased electron beam current density.

13. The electron gun of claim 12 wherein $D_G \approx 0.01$ inch.

14. An electron gun for directing an electron beam on a display screen, said electron gun having a low voltage beam forming region (BFR) and a high voltage focusing and accelerating region wherein electrons are accelerated by an anode voltage $V_A$ toward said display screen, said electron gun comprising:

cathode means for emitting thermal electrons in the general direction of an axis of the electron gun;

a first charged grid disposed in a spaced manner from said cathode means on said axis and having a first aperture with a diameter $d_1$ through which the electrons are directed, wherein the spacing $D_G$ between said cathode means and said first charged grid is such as to admit an increased number of energetic electrons in the beam for increased electron beam current density;

a second charged grid disposed in a spaced manner from said first charged grid and on said axis and intermediate said first charged grid and said high voltage focus region and having first and second recessed portions extending inwardly from opposed facing surfaces of said second charged grid and aligned on said axis, with each of said recessed portions having a diameter $d_2$, where $d_1 > d_2$ and wherein the electrons are directed through said first and second recessed portions toward the display screen and said second charged grid further includes means for forming a relatively electrostatic field-free region on said axis within said second charged grid; and means disposed on the axis of the electron gun in the relatively field-free region of said second charged grid for removing electrons disposed about the periphery of said electron beam as well as electrons having a high velocity transverse to said axis in reducing electron beam cross-section and electron beam spot size on said display screen.

15. The electron gun of claim 14 wherein said means for removing electrons from the beam includes a generally circular limiting aperture having a diameter $d_2'$ disposed on said axis and in said relatively field-free region.

16. The electron gun of claim 15 wherein said second charged grid has a thickness $t_2$, where $t_2 \geqq 1.8\ d_2$.

17. The electron gun of claim 16 wherein $t_2 \geqq 0.54-1.44$ mm and $d_2 = 0.3-0.8$ mm.

18. The electron gun of claim 17 wherein $d_2' = 10\text{–}50\%\ d_2$.

19. The electron gun of claim 18 wherein said second charged grid is maintained at a potential of $V_{G2}$, where $300V \leqq V_{G2} \leqq 0.12\ V_A$.

20. The electron gun of claim 19 wherein $D_G \approx 0.01$ inch.

21. The electron gun of claim 16 wherein said limiting aperture is disposed approximately midway between the opposed surfaces of said second charged grid.

22. The electron gun of claim 21 wherein said second charged grid includes an inwardly extending partition disposed intermediate and aligned with said first and second recessed portions and having a circular aperture therein.

23. The electron gun of claim 14 wherein said electron gun is in a color cathode ray tube (CRT) and includes three inline cathode means and wherein said first charged grid includes three first apertures and said second charged grid includes three pairs of first and second recessed portions and three limiting apertures aligned with the three first apertures of said first charged grid for forming and directing three inline electron beams onto the display screen.

24. The electron gun of claim 23 wherein said electron gun further includes three inline high voltage focusing means for focusing said three electron beams on the display screen.

25. The electron gun of claim 14 wherein the voltage in the low voltage BFR of the electron gun is equal to or less than 12% of the voltage in said high voltage focusing region.

26. The electron gun of claim 14 wherein $d_1 > d_2$ for admitting an increased number of thermal electrons in the beam.

27. A lens for focusing an electron beam comprised of thermal electrons emitted by a source and focused by a main lens along an axis toward a display screen, said lens comprising:

low voltage beam forming means disposed adjacent the source of thermal electrons for forming the thermal electrons into a beam with a beam crossover on said axis, said beam forming means comprising:

a first charged grid disposed a distance $D_1$ from the source of electrons and having a first generally circular aperture disposed along said axis and having a diameter $d_1$, wherein the distance $D_1$ allows for the admission of an increased number of thermal electrons in the beam via the first aperture in said first charged grid; and a second charged grid disposed intermediate said first charged grid and said main lens and having first and second recessed portions extending inwardly from opposed facing surfaces thereof and aligned on said axis, with each of said recessed portions having a diameter $d_2$, with $d_1 > d_2$, and wherein the electrons are directed through said first and second recessed portions toward the display screen, said second charged grid further including means for forming a relatively electrostatic field-free region on said axis within said second charged grid, wherein said second charged grid further includes means defining a limiting aperture on said axis in the relatively electrostatic field-free region of said second charged grid for removing electrons in a peripheral portion of the electron beam in reducing electron beam spot size on the display screen; and high voltage focusing and accelerating means disposed on said axis intermediate said second charged grid and said display screen for applying an anode voltage $V_A$ to the electron beam for focusing the electrons on and accelerating the electrons toward the display screen.

28. The electron beam focusing lens of claim 27 wherein said limiting aperture is generally circular having a diameter $d_2'$ and said means defining said limiting aperture is disposed intermediate said first and second recessed portions of said second charged grid.

29. The electron beam focusing lens of claim 28 wherein said second charged grid has a thickness $t_2$, where $t_2 \geqq 1.8\ d_2$.

30. The electron beam focusing lens of claim 29 wherein said means defining said limiting aperture includes an inwardly extending partition disposed approximately midway between the opposed surfaces of said second charged grid.

31. The electron beam focusing lens of claim 27 wherein $t_2 \geqq 0.54-1.44$ mm and $d_2=0.3-0.8$ mm.

32. The electron beam focusing lens of claim 27 wherein $d_2'=10\text{–}50\%\ d_2$.

33. The electron beam focusing lens of claim 25 wherein said second charged grid is maintained at a potential of $V_{G2}$, where $300V \leqq V_{G2} < 0.12\ V_A$.

34. The electron beam focusing lens of claim 33 wherein said electron beam focusing lens is in a color cathode ray tube (CRT) and includes three inline electron sources and wherein said first charged grid includes three first apertures and said second charged grid includes three pairs of first and second recessed portions and three limiting apertures aligned with the three first apertures of said first charged grid for forming and directing three inline electron beams onto the display screen.

35. The electron beam focusing lens of claim 34 further including three inline high voltage focusing means for focusing said three electron beams on the display screen.

36. The electron beam focusing lens of claim 34 wherein $d_1 \geqq 15\%$ larger than $d_2$.

37. The electron beam focusing lens of claim 34 wherein the voltage in the low voltage beam forming means is equal to or less than 12% of the anode voltage $V_A$.

38. The electron beam focusing lens of claim 27 wherein $D_1 \approx 0.01$ inch.

* * * * *

UNITED STATES PATENT AND TRADEMARK OFFICE

CERTIFICATE OF CORRECTION

PATENT NO. : 5,220,239

DATED : June 15, 1993

INVENTOR(S) : Hsing-Yao Chen

It is certified that error appears in the above-indentified patent and that said Letters Patent is hereby corrected as shown below:

| COLUMN | LINE | |
|---|---|---|
| 2 | 45 | After "FIG.", delete "i" and insert --1-- therefor. |
| 5 | 33 | After "FIG.", delete "210" and insert --2-- therefor. |
| 5 | 58 | After "60", insert --.-- |
| 6 | 6 | Delete "$t_{G1}$" and insert --$d_{G1}$'-- therefor. |
| 6 | 15 | Delete "$D_{G1}$'" and insert --$d_{G1}$'-- therefor. |
| 6 | 19 | Insert -->-- between "$d_{G1}$'" and "$d_{G1}$". |
| 6 | 64 | Delete "$D_{G1}$'" and insert --$d_{G1}$'-- therefor. |
| 7 | 55 | Delete "6" and insert --69-- therefor. |
| 7 | 59 | Delete "7" and insert --76-- therefor. |

UNITED STATES PATENT AND TRADEMARK OFFICE

CERTIFICATE OF CORRECTION

PATENT NO. : 5,220,239

DATED : June 15, 1993

INVENTOR(S) : Hsing-Yao Chen

It is certified that error appears in the above-indentified patent and that said Letters Patent is hereby corrected as shown below:

| COLUMN | LINE | DESCRIPTION |
|---|---|---|
| 7 | 66 | Delete "he" and insert --the-- therefor. |

Signed and Sealed this

Twenty-second Day of March, 1994

Bruce Lehman

*Attest:*

BRUCE LEHMAN

*Attesting Officer*

*Commissioner of Patents and Trademarks*